US006216397B1

(12) United States Patent
Chang

(10) Patent No.: US 6,216,397 B1
(45) Date of Patent: Apr. 17, 2001

(54) MODULAR PARTITION

(76) Inventor: Chao-Yu Chang, 4th Fl., No. 12, Lane 80, Pao-Hsing St., Wan-Hua Dist., Taipei (TW)

( * ) Notice: Subject to any disclaimer, the term of this patent is extended or adjusted under 35 U.S.C. 154(b) by 0 days.

(21) Appl. No.: 09/189,049

(22) Filed: Nov. 9, 1998

(51) Int. Cl.[7] ..... E04B 2/78

(52) U.S. Cl. ..... 52/36.1; 52/36.6; 52/239

(58) Field of Search ..... 52/36.1–36.6, 52/588.1, 589.1, 239; 108/91, 180, 186, 193, 149; 312/265.1–265.4; 211/94.01, 189; 160/135, 351

(56) References Cited

U.S. PATENT DOCUMENTS 4,120,124 * 10/1978 Temple et al. ..... 52/36.6
4,434,900 * 3/1984 Cook ..... 52/36.1
4,545,168 * 10/1985 Dalton, Jr. ..... 52/36.6
4,716,692 * 1/1988 Harper et al. ..... 52/36.6
4,805,783 * 2/1989 Mayer ..... 211/94.01
5,014,476 * 5/1991 Leslie et al. ..... 52/284 X
5,069,263 * 12/1991 Edwards ..... 52/36.6 X
5,724,779 * 3/1998 Chang ..... 52/239

* cited by examiner

*Primary Examiner*—Richard Chilcot
(74) *Attorney, Agent, or Firm*—Patterson, Thuente, Skaar & Christensen, P.A.

(57) ABSTRACT

A modular partition is composed of a plurality of posts, panels and shelves detachably interconnected therebetween. Disposing different specifications and varied amounts of the panels between the posts according to specific requirement can form partition walls with varied arrangements. The shelves disposed between any two of the walls can be mounted on any one of the panels to obtain desired heights.

12 Claims, 6 Drawing Sheets

MODULAR PARTITION

BACKGROUND OF THE INVENTION

1. Field of the Invention

The present invention relates to a modular partition, and more particularly to a partition, which can be assembled into simple furniture, such as shelves, desks, etc, to fully use the space of a room.

2. Description of Related Art

In offices, panels are generally used to partition a large space into smaller individual working spaces. The arrangement of the partitions can be varied according to different specifications of the panel. In additional, manufacturers provide Office Automation (OA) furniture designed to be used with the standard arrangement of partitions.

However, OA furniture is not suitable for houses or apartments in which space is limited. Furthermore, panels are an integrated design with fixed specifications so that a special combination of partitions with fixed specifications to fit in the limited space is impossible.

A modular partition in accordance with the present invention tends to mitigate and/or obviate the aforementioned problem.

SUMMARY OF THE INVENTION

The main object of the present invention is to provide a modular partition which has a height and width that can be varied according to different needs.

Another object of the present invention is to provide a modular partition which is easy to be assembled or disassembled.

Other objects, advantages and novel features of the invention will become more apparent from the following detailed description when taken in conjunction with the accompanying drawings.

DETAILED DESCRIPTION OF THE PREFERRED EMBODIMENT

Figure 1:
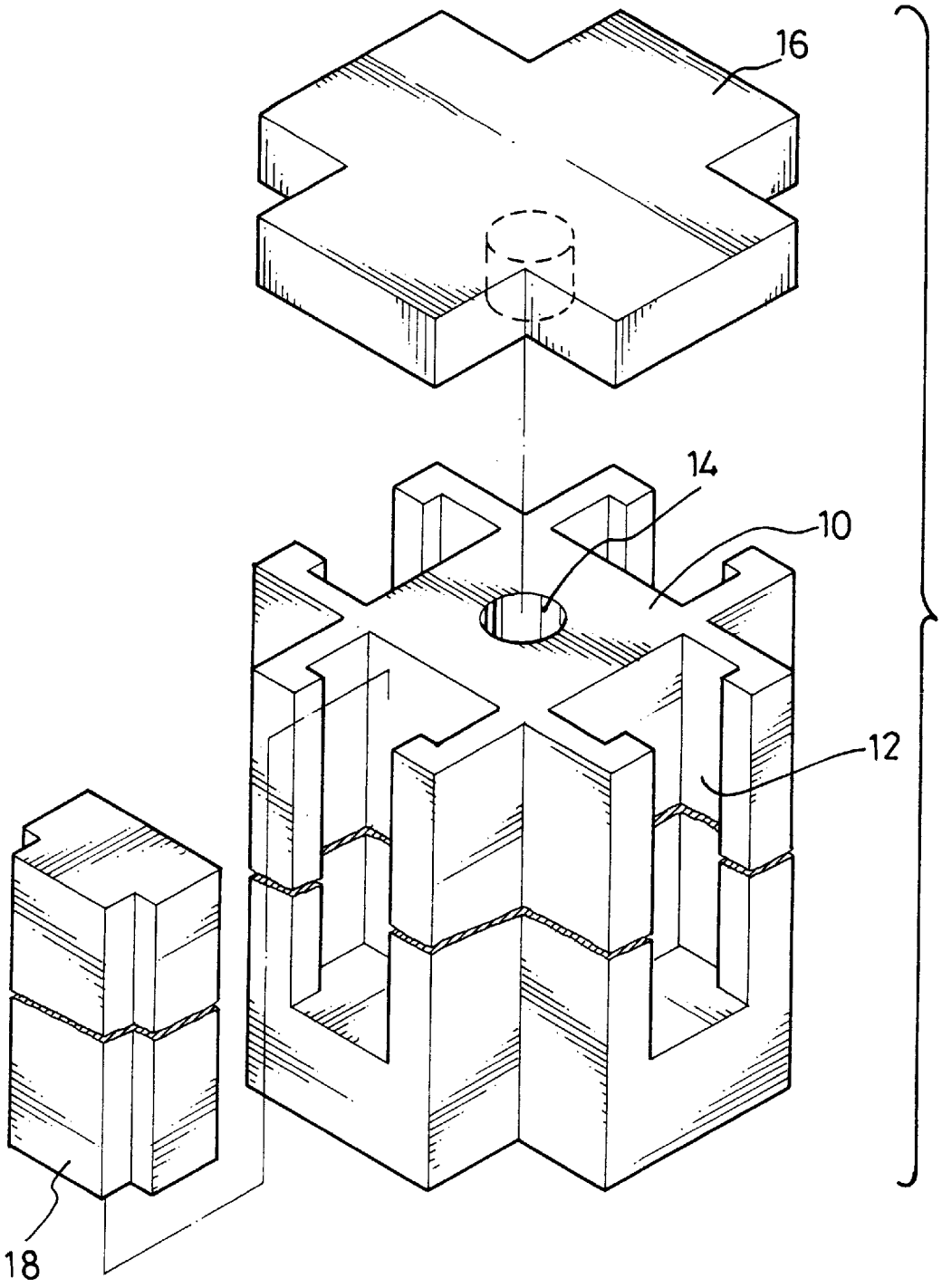
FIG. 1 is an exploded view of a post of the present invention.
Figure 2:
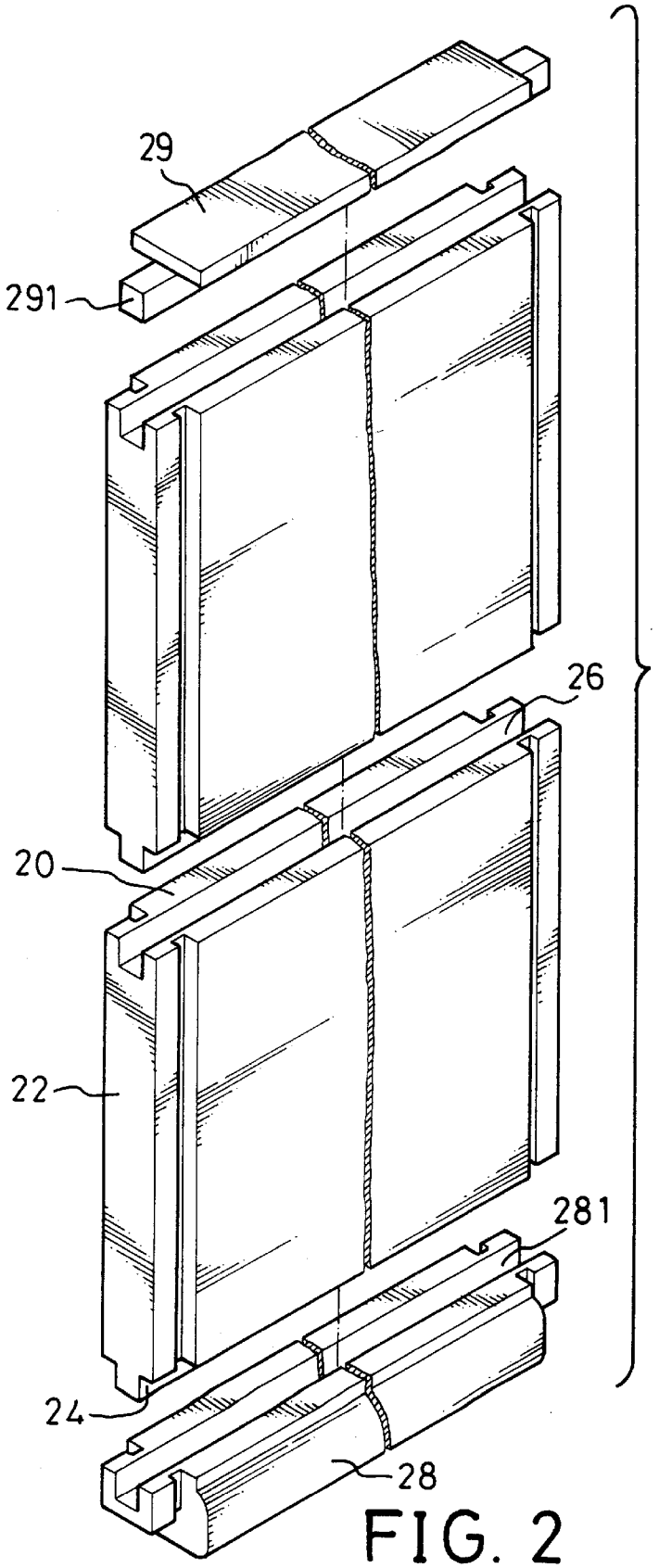
FIG. 2 is an exploded view of a first preferred embodiment of a panel of the present invention.
Figure 3:
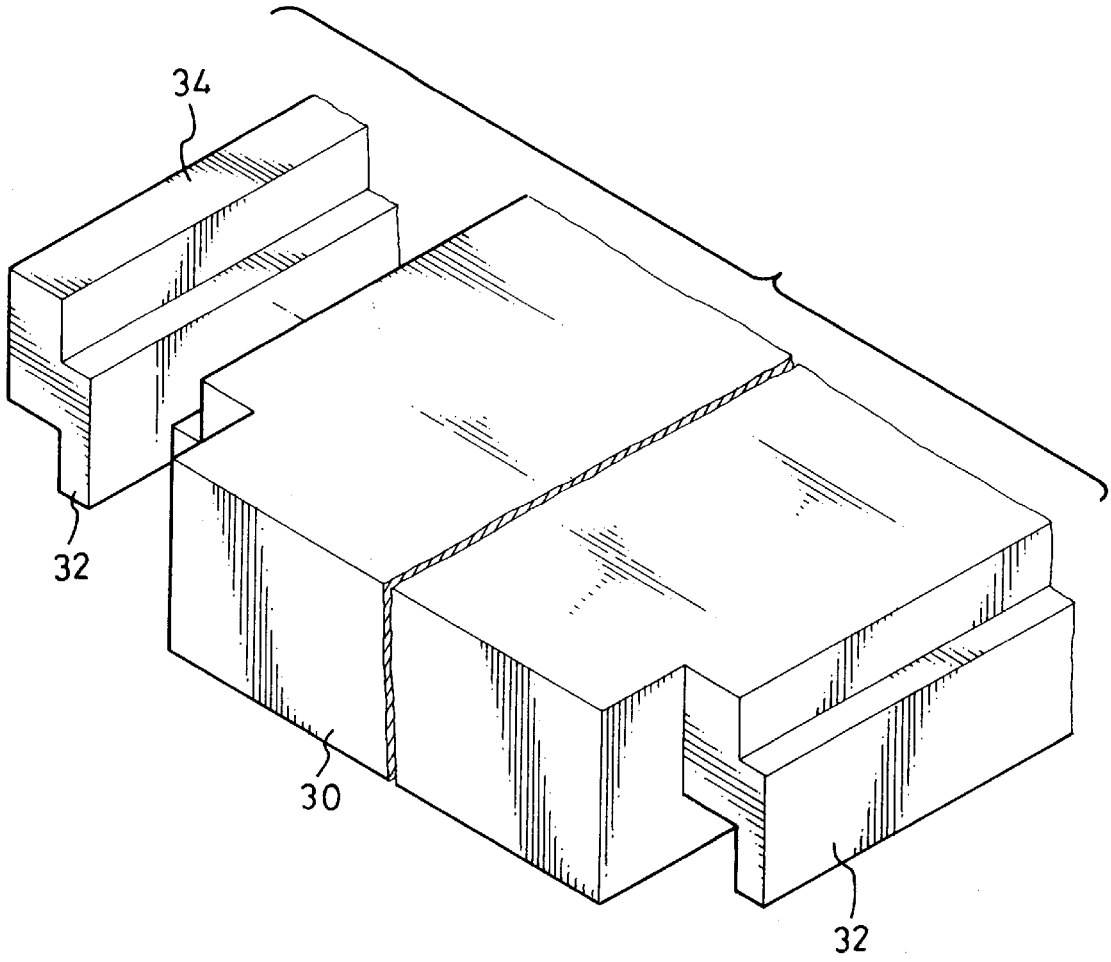
FIG. 3 is a perspective view of a shelf of the present invention.

A modular partition of the present invention is constructed to have three parts: posts (10), panels (20) and shelves (30). FIGS. 1–3 respectively show the structure of the post (10), the panel (20) and the shelf (30).

Referring to FIG. 1, the post (10) defines T-shaped channels (12) in side faces thereof. A hole (14) is defined in the center of the top face of the post (10). A cover (16), which forms a pin (not numbered) on the bottom thereof, is provided on the top face of the post (10) so that the pin is able to be received in the hole (14). The top profile of the cover (16) corresponds to the cross section of the post (10). A T-shaped blank (18) is provided to fill unused channels (12).

The panel (20) is shown in FIG. 2. The panel (20) has ends (22) adapted to be slidably received in a channel (12). A groove (26) is defined in the top face thereof, and a tongue (24) is formed on the bottom thereof. The tongue (24) can be received in the groove (26) of another panel (20). With such a construction, a plurality of panels (20) are stacked with one on top of another to construct a partition wall. A bottom rail (28) having a groove (281) defined therein is provided to accommodate the bottom panel (20). The tongue (24) of the panel (20) can also be received in the groove (281) of the bottom rail (28). The bottom of the bottom rail (28) is a plane to stably support the partition wall on the floor. Both ends of the bottom rail (28) are constructed and adapted to be mated with the channels (12) of the posts (10). A top rail (29) is provided for installation on the top panel (20). A tongue (291) is formed on the bottom of the top rail (29) and is engaged in the groove (26) of the top panel (20). The length of the top rail (29) is less than that of the tongue (291); such that the ends of the bar (291) when received in the groove (26) are flush with the cover (16).

Figure 4:
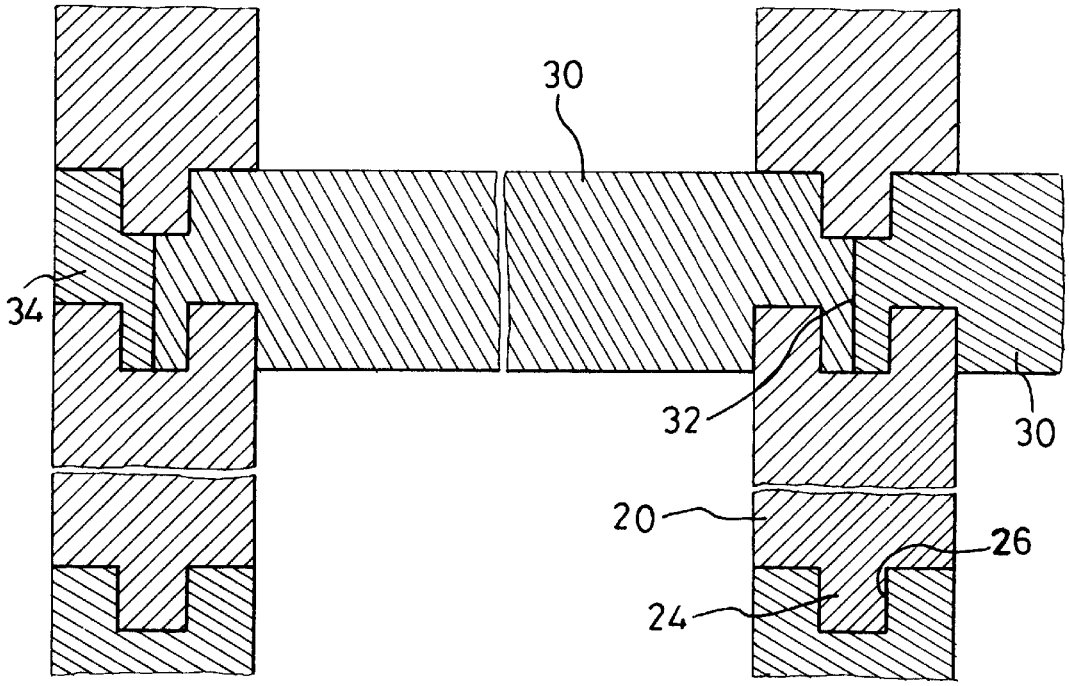
FIG. 4 is a top plan cross sectional view showing the assembly of two shelves and two panels.

Referring to FIG. 3, the shelf (30) of the present invention provides steplike ends (32) on both sides. The width of the bottom of the steplike end (32) is half of that of the groove (26) of the panel (20). Therefore, two step-like ends of two shelves (30) can be accommodated in one groove (26) at the same time, as shown in FIG. 4. A shelf blank (34) also has a step-like end (32) is filled in the groove (26) of the panel (20) when provided with only one step-like end (32) of the shelf (30) in the groove (26).

Figure 5A:
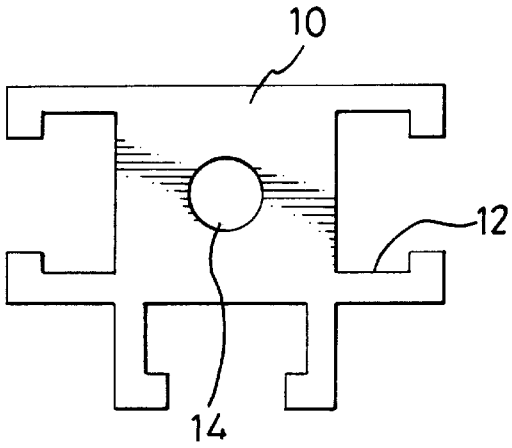
FIG. 5A is a plan view showing a second preferred embodiment of a post of the present invention.
Figure 5B:
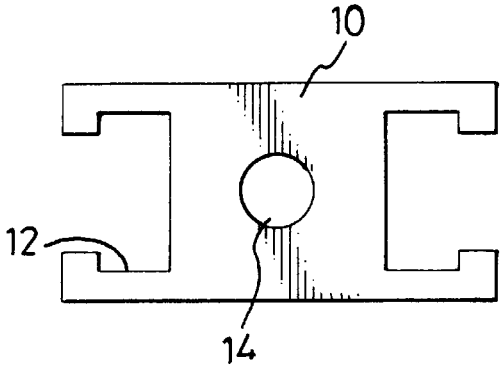
FIG. 5B is a plan view showing a second preferred embodiment of a post of the present invention.
Figure 5C:
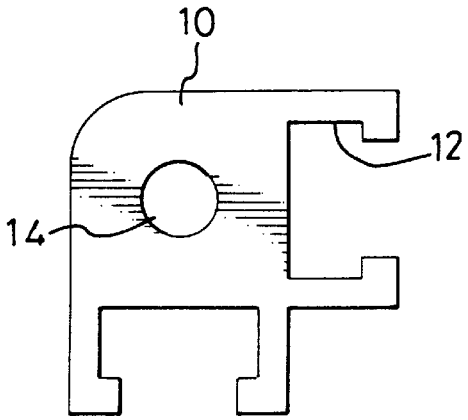
FIG. 5C is a plan view showing a second preferred embodiment of a post of the present invention.
Figure 5D:
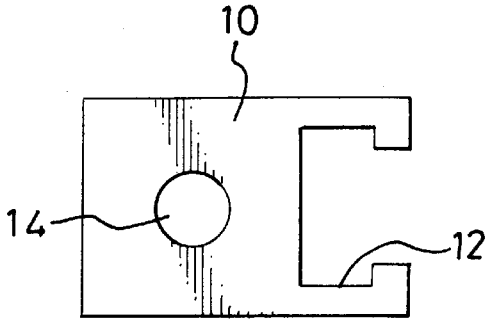
FIG. 5D is a plan view showing a second preferred embodiment of a post of the present invention.

Referring to FIGS. 5A to 5D, apart from the preferred embodiment of the post (10) which has four channels (12) equally spaced apart from each other, the post (10) also has other designs to accommodate different user requirements. The post (10) has three channels (12), as shown in FIG. 5A. The post (10) has two channels (12) 180 degrees apart, as shown in FIG. 5B, or 90 degrees apart from each other, as shown in FIG. 5C. FIG. 5D shows that the post (10) has only one channel (12) defined therein.

Figure 6:
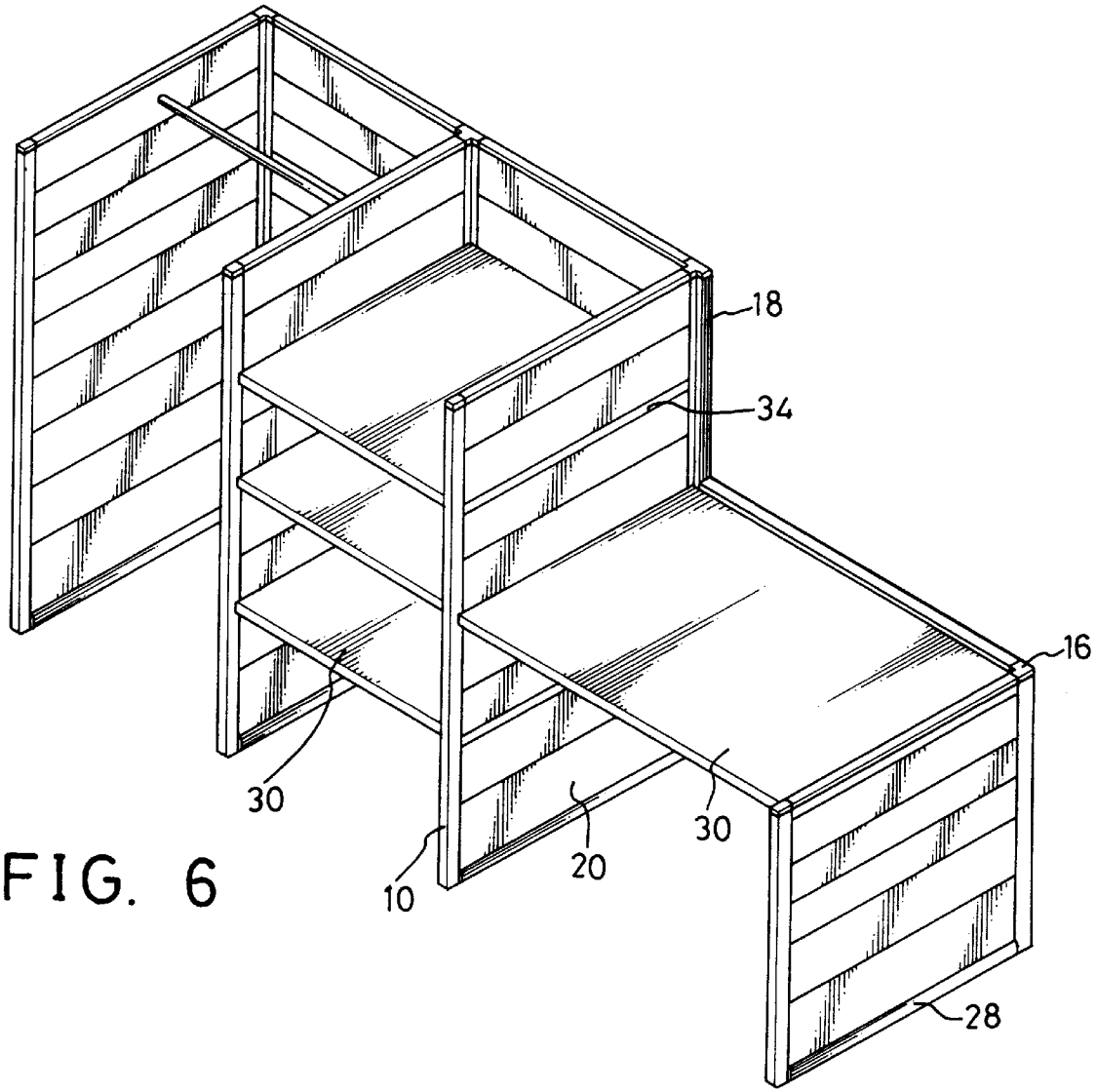
FIG. 6 is a perspective view of an exemplary assembled embodiment in accordance with the present invention.

FIG. 6 shows a practical example constructed from elements of the present invention. The posts (10) and the panel s (20) together form a partition wall. One shelf (30) is placed in the right of the wall to form a table. Three shelves (30) are spatially connected between two walls orthogonal to the partition wall to form storage shelves. At the left of the wall, a beam can be used between two opposed panels (20) for hanging clothes.

Furthermore, the specifications of the post (10), the panel (20) and the shelf (30) are varied. A user can implement desired configurations by varying specifications of the post (10), the panel (20) and the shelf (30).

The advantages of the present invention are:

1. Since the partition wall is formed by a plurality of panels (20) instead of an integrated wall, the partition can be implemented in various heights.
2. Because the volume of the individual elements is not large before assembly, it is easy to transport and store.
3. Little wood is used in the construction of the product, so it is environmentally friendly.

It is to be understood, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular partition comprising:

a post having at least one channel defined therein;

one or more panels having ends slidably received in the channel, a groove defined in a top face thereof and a tongue formed in the bottom thereof, such that the tongue is able to be engaged in the groove of a lower panel;

a shelf adapted to be received in the groove and beside the end of the panel; and a bottom rail disposed beneath a bottom panel, wherein the bottom rail includes a bottom face having a wide plane to stably support the modular partition on a surface.

2. The modular partition as claimed in claim 1 further comprising a cover having a pin formed on the bottom thereof to be detachably engaged with the post.

3. The modular partition as claimed in claim 1, wherein a blank is provided to fill one of the channels.

4. The modular partition as claimed in claim 1, wherein a top rail is disposed on a top panel and forms a tongue on the bottom thereof, the tongue being engaged within the groove of the top panel, the length of the top rail being less than that of the tongue.

5. The modular partition as claimed in claim 1, wherein the channels of the post each are close to a bottom end of the post, and the bottom rail includes ends, which are constructed to match the channel.

6. The modular partition as claimed in claim 1, wherein the shelf has step-like ends capable of engaging the groove of the panel.

7. The modular partition as claimed in claim 6, wherein the width of the step-like ends of the shelf are half of that of the groove of the panel.

8. The modular partition as claimed in claim 7, wherein a shelf blank fills in the groove of the panel when only one shelf is engaged within the groove of the panel.

9. The modular partition as claimed in claim 1, wherein the post has a single channel.

10. The modular partition as claimed in claim 1, wherein the post has two channels.

11. The modular partition as claimed in claim 1, wherein the post has three channels.

12. The modular partition as claimed in claim 1, wherein the post has four channels.

* * * * *